United States Patent [19]

Katona

[11] 4,023,554

[45] May 17, 1977

[54] SELF-CONTAINED WINDOW UNIT FOR OVEN DOORS

[75] Inventor: Joseph W. Katona, Walled Lake, Mich.

[73] Assignee: Mills Products, Inc., Farmington, Mich.

[22] Filed: Feb. 12, 1976

[21] Appl. No.: 657,472

[52] U.S. Cl. ..... 126/198; 126/200

[51] Int. Cl.[2] ..... F23M 7/04

[58] Field of Search ..... 126/198, 200; 52/616, 52/304

[56] References Cited

UNITED STATES PATENTS

| | | | |
|---|---|---|---|
| 3,692,015 | 9/1972 | Chase et al. | 126/200 |
| 3,828,763 | 8/1974 | Wilson | 126/200 |
| 3,855,994 | 12/1974 | Evans et al. | 126/198 |
| 3,893,442 | 7/1975 | Nuss | 126/198 |

*Primary Examiner*—Kenneth W. Sprague
*Assistant Examiner*—Larry I. Schwartz
*Attorney, Agent, or Firm*—Whittemore, Hulbert & Belknap

[57] ABSTRACT

A self-contained window unit adapted to be assembled into an oven door window opening and having means defining an air passage to allow air to flow upwardly through the door and window unit therein. The window unit is mounted on the back panel or liner of the door and comprises a window sub-assembly having a pair of glass panes held in spaced parallel relation. A front glass pane is secured to the subassembly by mounting clips. The mounting clip or clips at the top are constructed so as normally to hold the front pane against upward movement but to permit the front pane to be pressed outwardly for upward removal. The spaces between the clips allow upward flow of air through the door and window unit.

13 Claims, 2 Drawing Figures

SELF-CONTAINED WINDOW UNIT FOR OVEN DOORS

BACKGROUND AND SUMMARY OF THE INVENTION

Window units for oven doors conventionally have consisted of constructions in which the space between the glass panes is sealed to prevent oven vapors from penetrating that space and subsequently condensing on the glass surfaces. Such constructions result in the outer surface of the outer glass pane reaching fairly high temperatures. Various attempts have been made to reduce the temperature of the outer pane by providing for the flow of air by convection over the inner surface of the outer pane. Such proposals have involved constructions that could not utilize a self-contained window unit adapted for easy installation into the oven doors of the various manufacturers. Previous constructions sometimes have employed an outer glass pane mounted on the front door panel rather than forming a part of a self-contained unit. That is more expensive and often requires a mounting clip or clips welded to the front door panel. A weld of this kind can show through and be unsightly.

The present invention provides a self-contained three-pane window unit in which the front or outer glass is a part of the unit. Moreover, the self-contained window unit of the present invention permits a maximum air flow and minimum thermal conduction. It can be utilized in present door assemblies having air flow cooling means without additional tooling.

The self-contained window unit of the present invention is designed to permit easy removal of the front glass pane for cleaning the air passage through the window unit.

The window unit of the present invention has a sealed two-pane package that minimizes heat radiation to the air passage.

The three-pane self-contained window unit can be manufactured at low cost by eliminating material waste and expensive tooling otherwise required to produce air wash slots. Since the unit is self-contained, range manufacturers need not concern themselves with washing and mounting individual pieces of glass to the front and rear door panels.

Further advantages of the present invention include the provision of easy removal of the front glass pane by an upward sliding movement to facilitae cleaning of the air passage. This is accomplished in the present instance by the construction of mounting clips particularly along the top of the assembly which permit the front pane to be pressed outwardly clear of the top clips and then to be removed by upward sliding.

Other objects and features of the invention will become more apparent as this description proceeds, especially when taken in conjunction with the accompanying drawings wherein.

Figure 1:
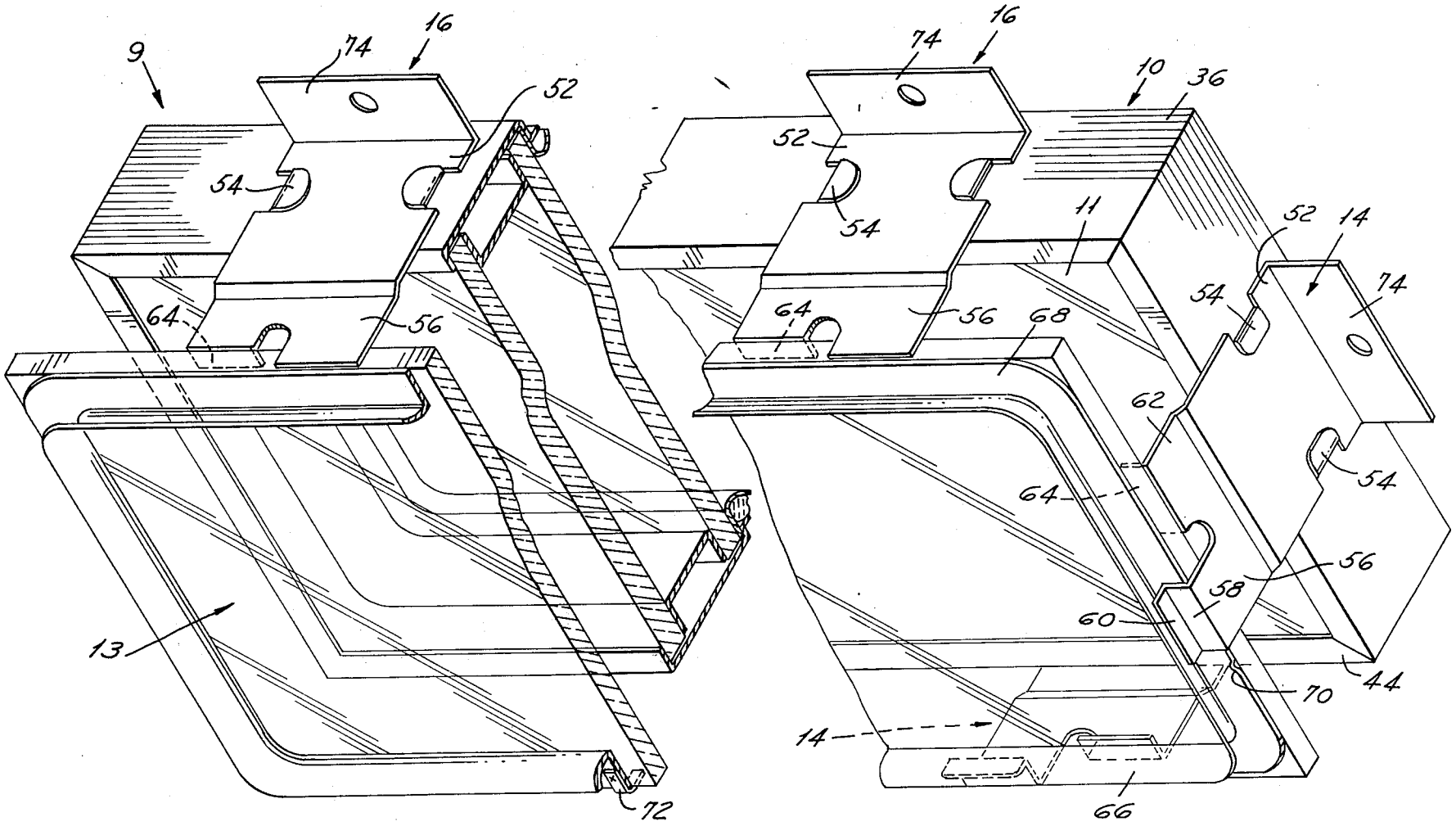
FIG. 1 is a perspective view with parts broken away and in section of a self-contained window unit embodying my invention.

Referring now more particularly to the drawings, the self-contained window unit 9 comprises a window sub-assembly 10 having glass panes 11 and 12, and a front glass pane 13 releasably secured to the sub-assembly 10 by mounting clips 14 along the bottom and side edges of the window unit and by mounting clips 16 along the top edge of the window unit.

Any or all of the three panes of glass may have a heat-reflecting coating to further reduce the front pane temperature. The inner glass pane 12 may also be of borosilicate composition for high temperature applications.

Figure 2:
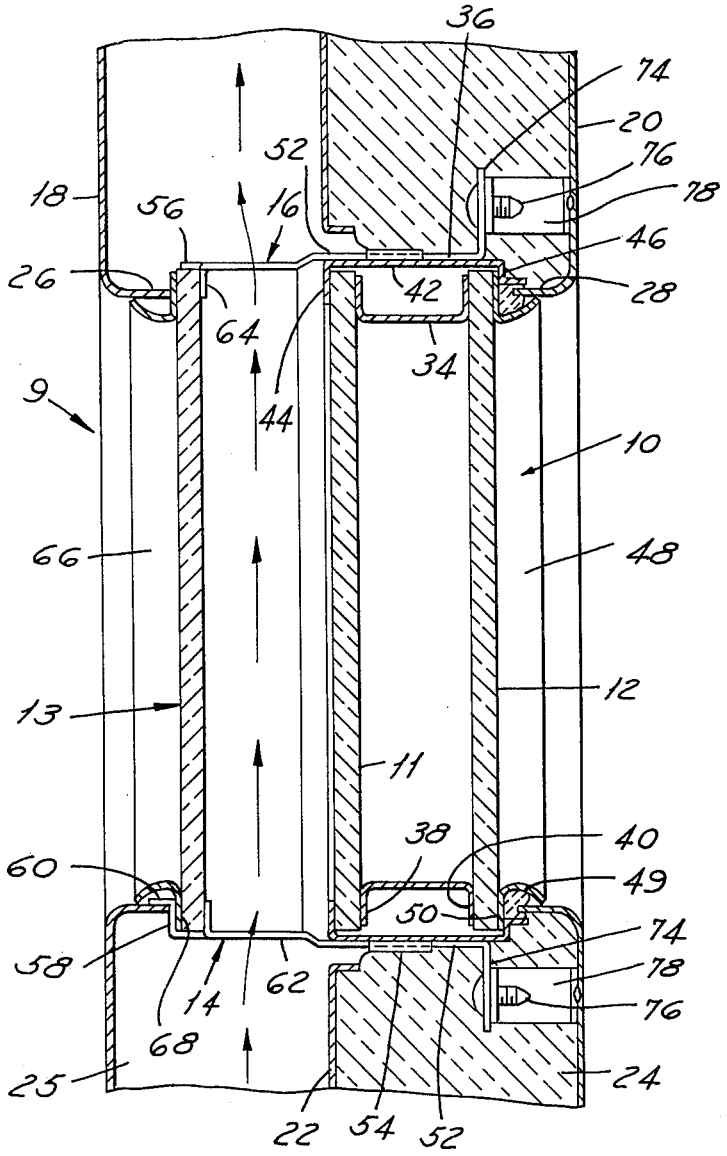
FIG. 2 is a fragmentary vertical sectional view showing the self-contained window unit of FIG. 1 mounted in an oven door.

FIG. 2 illustrates the window unit installed in an oven door which includes a front door panel 18, a back door panel or liner 20 and a centrally disposed baffle 22 which is adapted to retain insulating material 24 between the baffle 22 and the liner 20. An air passage 25 is defined between the front panel 18 and the baffle 22. The front door panel 18 has an annular rearwardly turned flange 26 and the liner 20 has an annular forwardly turned flange 28. The flanges 26 and 28 define registering apertures constituting the opening of the oven door in which the window unit is installed.

The glass panes 11 and 12 of the sub-assembly 10 are maintained in spaced parallel relationship by the spacer 34 and clamping frame 36. The spacer 34 is an annular member of channel cross section having radially outwardly turned flanges 38 and 40 in contact with the inner peripheral surfaces of the glass panes 11 and 12. The outer frame 36 is an annular member of channel cross section. The base 42 of the channel extends about the peripheral edges of the glass panes 11 and 12 and the radially inturned flanges 44 and 46 extend along the outer peripheral surfaces of the glass panes 11 and 12. Together the spacer 34 and the outer frame 36 secure the glass panes 11 and 12 together in a fixed spaced parallel relationship.

An annular trim ring or moulding 48 of generally J shape in cross section extends around the outer peripheral surface of the rear glass pane 12. The trim ring or moulding 48 has a radially outwardly extending leg 50 which extends between and contacts the outer peripheral surface of pane 12 and the flange 46 of the outer frame 36. An elongated asbestos cord 49 extends within the trim ring and seals against the edge of flange 28 of the liner 20 when the window unit is installed in the door. Instead of asbestos, the cord may be of fiberglass or in the form of a silicone extrusion.

The flanges 44 and 46 of the outer frame 36 engage the outer surface of the front panel 11 and the leg 50 of the trim ring 48, and the spacer flanges 38 and 40 engage the inner surfaces of the panes 11 and 12 to clamp the window sub-assembly 10 together and form a sealed two-pane window package.

The front pane 13 is releasably secured to the window sub-assembly 10 by the mounting clips 14 and 16. These clips hold the front pane 13 in front of the sub-assembly 10 in spaced relation to the pane 11. One or more of the clips 14 are provided on each side edge of the window unit and one or more of the clips 14 are provided along the bottom edge thereof. One or more clips 16 are provided along the top edge of the unit. The spaces between the clips 14 at the bottom of the unit and the clips 16 at the top of the unit provide openings communicating with the air passage 25 in the door to allow air to flow upwardly between panes 11 and 13.

Each clip 14 has a plate portion 52 which is secured to the base 42 of the mounting frame 36 as by means of integral tabs 54 on the mounting frame. A leg 56 of the clip 14 projects forwardly from the plate portion 52 across the peripheral edge of the front pane 13 and has a laterally inwardly turnd flange 58 extending over the front peripheral surface of the pane 13 terminating in a forwardly turned flange 60. A second leg 62 extends forwardly from the plate portion 52 of clip 14 and terminates in a laterally inwardly turned flange 64 which extends over the rear peripheral surface of the front pane 13 in contact therewith.

An annular trim ring or moulding 66 extends about the front peripheral surface of the pane 13. This trim ring is generally J-shape in cross section and one leg 68 thereof extends between and contacts the outer surface of the pane 13 and the flange 58 of clip 14.

The clip 16 along the top of the window unit are exactly like the clips 14 except that the flanges 58 and 60 are omitted and the leg 56 is cut short so as to extend only part way across the top peripheral edge of the outer pane 13. In a broad sense, the leg 56 could conceivably extend entirely across the top edge of the pane 13 and even slightly although not appreciably beyond. However, preferably the leg 56 is as shown in the drawings.

The flanges 58 of clips 14 and flanges 64 of clips 14 and 16 clamp the front pane 13 against forward or rearward movement. The legs 56 of clips 14 prevent sidewise and downward movement of pane 13 and the legs 56 of clips 16 normally prevent upward movement of the pane. However, the pane may be pressed outward at the top a distance sufficient to clear legs 56 and then removed by an upward movement. As previously stated, the legs 56 of the top clips 16 preferably do not extend completely across the edge of the pane and this is to facilitate removal, but slightly longer legs may be employed if desired without loss of the removability feature.

Leg 68 of the trim ring 66 is deformed to provide an offset 70 along each side of the trim ring beneath the clip 14. The offsets 70 act as detents preventing the trim ring from falling out during shipping and assembly by shaking free of the legs 56 of the top clips 16 and sliding upwardly. Alternatively, the trim ring may be retained from falling out by the use of a tab 72 spot-welded or otherwise secured to the bottom portion of the trim ring 66 and folded or bent under the lower peripheral edge of the pane 13. Both methods, that is the offset 70 and the tab 72, are shown in FIG. 1, but it will be understood that ordinarily only one such method of retaining the trim ring is employed.

The mounting clips 14 and 16 have rear flanges 74 for the purpose of mounting the window unit within the window opening of the oven door. FIG. 2 shows the window unit installed in the oven door with the clip flanges 74 secured by fasteners 76 to brackets 78 welded or otherwise secured to the rear panel or liner 20 of the door.

When the window unit is installed in the oven door, the clip flanges 60 fit within the annular flange 26 which defines the aperture in the front panel 18 of the oven door to hold and locate the window unit securely within the flanged opening 26. Thus even though the window unit is actually mounted to the back panel or liner 20 of the door, its front pane 13 is located and held in exact register with the flanged opening 26 of the front panel 18. The clip flanges 60 are also of sufficient strength to support the weight of the glass pane 13 during shipping and handling of the range.

Cooling air passing upward through the air passage 25 in the door flows through the space between the front pane 13 and the middle pane 11 without any appreciable interference from the clips 14 and 16 thereby cooling the inner surface of the front pane 13 to reduce the temperature of its outer surface. These clips are of relatively small width so that there are large open spaces between the clips for the free flow of the air. Thus there is provided a selfcontained window unit that provides a maximum air flow for cooling and a minimum of thermal conduction.

The front pane 13 and trim ring 66 may be easily removed, after removal of the front door panel 18 either by swinging it down or by completely separating it from the liner 20, by simply pressing the top edge of the pane forward sufficiently to clear the legs 56 of the top clips 16 and then sliding the pane 13 and trim ring 66 upwardly to completely separate them from the window unit. The air passage including the inner surfaces of the panes 11 and 13 may then be cleaned. The reverse steps are followed in order to re-assemble the front pane 13 and trim ring 66.

What I claim as my invention is:

1. A self-contained window unit adapted to be assembled into an oven door having front and back panels with aligned window openings therein and means defining an air passage to allow air to flow upwardly through the door and window unit therein, comprising a window sub-assembly having a pair of glass panes, means to hold said panes in spaced parallel relation, a third glass pane, and means for releasably securing said third glass pane to said window sub-assembly in a position at one side thereof and in spaced parallel relation to the adjacent glass pane of said sub-assembly, said securing means comprising a plurality of individual mounting clips attached to said holding means which are spaced apart so as to provide areas between said third pane and said adjacent pane of said sub-assembly at the top and bottom of said window unit defining openings communicating with the air passage in the door to allow the air to flow upwardly therebetween.

2. The self-contained window unit defined in claim 1, wherein said mounting clips include bottom and side clips at the bottom and side edges of said window unit releasably engaging peripheral portions of said third pane.

3. The self-contained window unit defined in claim 2, wherein each bottom and side clip has a part extending over the peripheral edge of said third pane and inner and outer flanges extending over the inner and outer peripheral surfaces respectively of said third pane.

4. The self-contained window unit defined in claim 3, wherein said mounting clips include at least one top clip at the top of said window unit; said top clip having a flange extending over the inner peripheral surface of said third pane, said top clip also having a terminal part extending over the peripheral edge of said third pane but not appreciably therebeyond so as normally to releasably hold said third pane against upward movement but permitting said third pane to be pressed outwardly clear of said terminal part for upward removal.

5. The self-contained window unit defined in claim 3, wherein said outer flanges of said bottom and side clips terminate in locating flanges projecting away from said outer surface of said third pane to hold and locate said third pane within the window opening of the front panel of the oven door.

6. The self-contained window unit defined in claim 1, wherein at least some of said clips have means adapted to be mounted on the back panel of the oven door.

7. The self-contained window unit defined in claim 3, including a trim ring engaging said outer peripheral surface of said third pane, said trim ring being overlapped and releasably retained by said outer flanges of said bottom and side clips.

8. The self-contained window unit defined in claim 3, said mounting clips including at least one top clip at the top of said window unit, said top clip having a flange extending over the inner peripheral surface of said third pane, said top clip also having a terminal part extending part way only over the peripheral edge of said third pane so as normally to releasably hold said third pane against upward movement but permitting said third pane to be pressed outwardly clear of said terminal part for upward removal, at least some of said clips having means adapted to be mounted on the back panel of the oven door.

9. The self-contained window unit defined in claim 8, said outer flanges of said bottom and side clips terminating in locating flanges projecting away from said outer surface of said third pane to hold and locate said third pane within the window opening of the front panel of the oven door.

10. The self-contained window unit defined in claim 9, including a trim ring engaging the outer peripheral surface of said third pane, about the top, bottom and side edges of said third pane, said trim ring being overlapped and releasably retained by said outer flanges of said bottom and side clips.

11. The self-contained window unit defined in claim 10, including means resisting upward removal of said trim ring.

12. The self-contained window unit defined in claim 11, wherein said means resisting upward removal of said trim ring comprises detents on said trim ring beneath said outer flanges of said side clips.

13. The self-contained window unit defined in claim 11, wherein said means resisting upward removal of said trim ring comprises a tab on the portion of said trim ring extending along the bottom of said third pane, said tab extending beneath the bottom edge of said third pane.

* * * * *